US005758731A

United States Patent [19]

Zollinger

[11] Patent Number: 5,758,731

[45] Date of Patent: Jun. 2, 1998

[54] METHOD AND APPARATUS FOR ADVANCING TETHERS

[75] Inventor: W. Thor Zollinger, Idaho Falls, Id.

[73] Assignee: Lockheed Martin Idaho Technologies Company, Idaho Falls, Id.

[21] Appl. No.: 613,563

[22] Filed: Mar. 11, 1996

[51] Int. Cl.[6] ..... E21B 43/00

[52] U.S. Cl. ..... 175/99; 175/51

[58] Field of Search ..... 175/19, 51, 99, 175/122; 604/101

[56] References Cited

U.S. PATENT DOCUMENTS

| | | | |
|---|---|---|---|
| 3,224,734 | 12/1965 | Hill et al. | 254/134.6 |
| 3,326,008 | 6/1967 | Baran et al. | 61/72.5 |
| 3,330,368 | 7/1967 | Baran et al. | 175/94 |
| 4,372,161 | 2/1983 | ed Buda et al. | 73/432 R |
| 4,558,751 | 12/1985 | Huffaker | 175/99 |
| 5,458,575 | 10/1995 | Wang | 604/101 |

FOREIGN PATENT DOCUMENTS

| | | | |
|---|---|---|---|
| 140397 | 2/1961 | U.S.S.R. | 175/99 |

*Primary Examiner*—William P. Neuder
*Attorney, Agent, or Firm*—Klaas Law O'Meara & Malkin

[57] ABSTRACT

A tether puller for advancing a tether through a channel may include a bellows assembly having a leading end fixedly attached to the tether at a first position and a trailing end fixedly attached to the tether at a second position so that the leading and trailing ends of the bellows assembly are located a substantially fixed distance apart. The bellows assembly includes a plurality of independently inflatable elements each of which may be separately inflated to an extended position and deflated to a retracted position. Each of the independently inflatable elements expands radially and axially upon inflation. An inflation system connected to the independently inflatable elements inflates and deflates selected ones of the independently inflatable elements to cause the bellows assembly to apply a tractive force to the tether and advance it in the channel.

6 Claims, 3 Drawing Sheets

METHOD AND APPARATUS FOR ADVANCING TETHERS

CONTRACTUAL ORIGIN OF THE INVENTION

The United States Government has rights in this invention disclosed under contract number DE-AC07-84ID12435 between the U.S. Department of Energy and Westinghouse Idaho Nuclear Company, now contract number DE-AC07-94ID13223 with Lockheed Idaho Technologies Company.

FIELD OF THE INVENTION

This invention relates to underground boring devices in general and more specifically to systems for advancing tethers trailed behind self-advancing underground boring devices.

BACKGROUND OF THE INVENTION

Underground boring devices are generally used to bore small tunnels underground for the installation of underground cables, piping, and other like apparatus. While many different kinds of underground boring devices exist, most are of the self-advancing variety, capable of boring the underground tunnel or channel without the need to be pushed from behind or pulled from the front. Rather than carry some type of on-board power source to provide the energy required to bore the tunnel, most self-advancing boring heads derive the energy for boring from a power center positioned at a remote location. The power for boring is then fed to the boring head by a tether. Depending on the particular requirements of the boring head, the tether may include electrical power cables or hydraulic or pneumatic hoses for providing power to the various devices mounted within boring head. Of course, the tether will also usually include the cable, wire, or pipe that is to be buried in the tunnel.

While such tethers provide a convenient means for supplying power to the boring heads, they are not without their disadvantages. Perhaps the most significant disadvantage is that the tethers produce a significant amount of drag. For example, tether drag tends to increase with the length of the tether and, of course, the number, size, and weight of the various cables, hoses, or pipes that comprise the tether. Tether drag also tends to increase exponentially with each turn. Quite obviously, if the tether drag exceeds the maximum forward thrust that can be produced by the self-advancing boring head, the boring head will stop advancing. Consequently, most tethered boring heads are limited to applications having relatively short runs with no more than about two or three 90° turns. Longer runs with more turns tend to increase the tether drag to the point where it can no longer be overcome by the boring head.

While numerous devices have been tried and are being used to reduce tether drag, most such devices are not without their disadvantages. For example, one device propels a drill head forward by peristaltic motion induced in a series of thin-walled tubes wound in a parallel arrangement around a long plastic tube that surrounds the tether. The peristaltic motion is created by pumping water rhythmically through chosen ones of the series of thin walled small tubes. Unfortunately, however, the wound plastic tubes can decrease the overall flexibility of the peristaltic motion device and add extra weight. Further, since the device is designed to be used with a hydraulic boring head (i.e., a head that bores a tunnel by directing a stream of water into the soil), the device has limited applications.

Other devices having similar designs have been developed for different purposes. For example, one such device is a "pipe crawler" for transporting inspection or repair equipment along the interior of a pipe. The pipe crawler includes three longitudinally separated inflatable chambers to which air is supplied and from which air is exhausted in a cyclic sequence. The leading and trailing chambers are radially expansible so that, when inflated, they contact the interior wall of the pipe. The middle chamber is of telescopic construction and may be alternately extended and retracted to advance each end of the device alternatively when the other end is secured. Unfortunately, however, the telescopic intermediate chamber is rigid and prevents the pipe crawler from negotiating sharp curves in the pipe. Moreover, the device is specifically designed to advance pipe inspection equipment inside rigid pipes and is not readily adaptable for use with underground boring heads.

A similar type of pipe crawler eliminates the rigid telescopic member used in the above-described device, thus allowing the pipe crawler to negotiate sharper bends in the pipe. Essentially, the pipe crawler includes an elongate cylindrical tube of flexible resilient material, such as latex rubber, that is partitioned by a plurality of longitudinally spaced plugs that are hermetically sealed to the wall of the tube. The plugs divide the tube into three longitudinally separated chambers. The inspection equipment mounted to the leading end of tube is advanced by supplying air to the chambers in a repeating cyclic sequence. When each chamber receives air, it expands radially and axially to contact the walls of the tube and to advance the inspection equipment. The sequence of inflation is such that the inspection equipment is propelled step by step along the tube. While this pipe crawler is somewhat more flexible than the pipe crawler previously mentioned, it has the disadvantage of requiring a hermetic seal between the plugs and the tether. The pipe crawler is also limited to use in advancing pipe inspection equipment within rigid pipes.

Consequently, a need exists for device for reducing or eliminating tether drag imposed on self-advancing tethered boring heads. Such a device should achieve a significant reduction in tether drag, thus allowing longer runs, but without adversely affecting the ability of the boring head to maneuver around underground obstacles, or restricting the number of turns. Additional advantages could be realized if the device could be used with a wide range of tethers and if the device could be customized to provide sufficient tractive force regardless of the magnitude of the tether drag.

SUMMARY OF THE INVENTION

A tether puller for advancing a tether through a channel may include a bellows assembly having a leading end fixedly attached to the tether at a first position and a trailing end fixedly attached to the tether at a second position so that the leading and trailing ends of the bellows assembly are located a substantially fixed distance apart. The bellows assembly includes a plurality of independently inflatable elements each of which may be separately inflated to an extended position and deflated to a retracted position. Each of the independently inflatable elements expands radially and axially upon inflation. An inflation system connected to the independently inflatable elements inflates and deflates selected ones of the independently inflatable elements to cause the bellows assembly to apply a tractive force to the tether and advance it in the channel.

Also disclosed is a method for advancing a tether through the channel. The first step in the method is to inflate the lead inflatable element to an expanded state so that the lead element frictionally engages the channel to prevent substantial axial movement of the tether within the channel. Then, while the lead element is in the expanded state, the tail element is inflated to an expanded state while the intermediate element is deflated. Once the tail element is fully inflated to the expanded state, the lead element is deflated while the intermediate element is inflated to an expanded state. The intermediate element is then maintained in the expanded state while the tail element is deflated and the lead element is again inflated to the expanded state.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
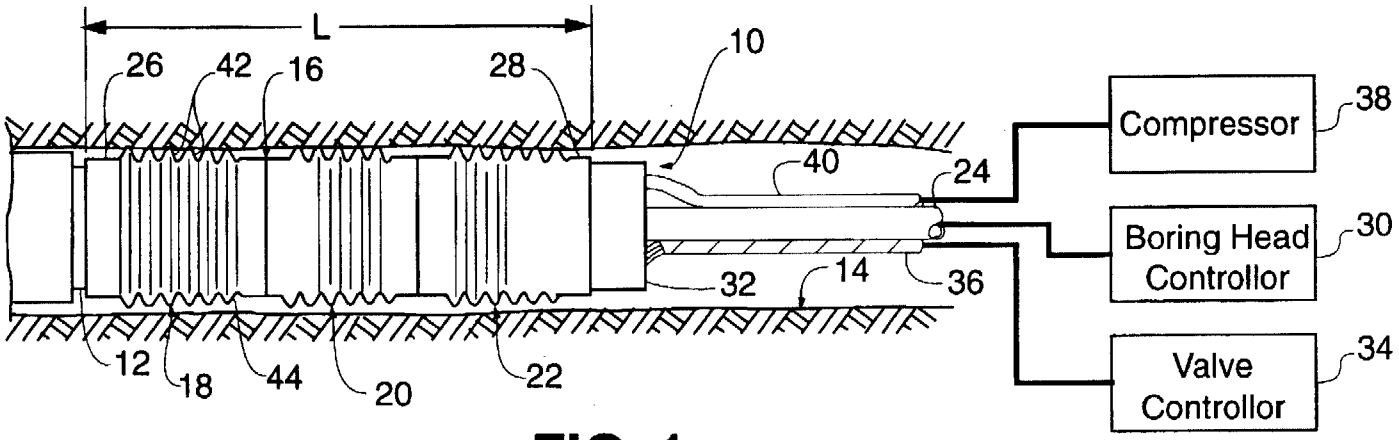
FIG. 1 is a side view in elevation of the tether pulling apparatus according to the present invention showing the lead inflatable element in the extended position.

A tether puller 10 is best seen in FIG. 1 as it could be used with a self-propelled boring head 12 of the type commonly used to bore an underground tunnel or channel 14. The boring head 12 may be connected by a tether 24 to a boring head control system 30 positioned at some remote location from the boring head 12. Depending on the particular application, the tether 24 may include electrical wires, cables, hoses, or any other of a wide variety of flexible, conduit-like members typically trailed behind such self advancing boring heads. In operation, the tether puller 10 applies a tractive force to the tether 24, pulling it along with the self-advancing boring head 12, thereby effectively reducing or eliminating the tether drag on the boring head 12.

The leading and trailing ends 26 and 28 of the tether puller 10 are fixedly attached to the tether 24 so that a length L between the leading and trailing ends 26 and 28 of the tether puller 10 remains substantially constant. The attachment of the leading and trailing ends 26 and 28 to the tether 24 also provides a convenient means for transferring to the tether 24 the tractive force produced by the tether puller 10.

The tether puller 10 includes a bellows assembly 16 having a plurality of independently inflatable elements 18, 20, and 22, each of which expands radially and axially upon inflation. In one preferred embodiment, the inflation and deflation of the independently inflatable elements 18, 20, and 22 is controlled by a valve assembly 32 that is mounted to the tail inflatable element 22. A plurality of valves (not shown) contained within the valve assembly 32 may be actuated by a valve control system 34 connected to the valve assembly 32 by a suitable signal link, such as an electrical cable 36. Compressed air (not shown) is used to inflate and deflate the various elements 18, 20, and 22, and may be provided to the valve assembly 32 by a compressor assembly 38 and hose 40.

The tether puller 10 applies tractive force to the tether 24 by the axial extension of the various elements 18, 20, and 22 that occurs when they are inflated. An initial starting point or state for the tether advance sequence is shown in FIGS. 1 and 5(*a*) in which the lead inflatable element 18 is in the fully inflated or extended position E. So inflated, the corrugations 42 of the outer bellows 44 of the lead inflatable element 18 are in contact with and frictionally engage the channel 14. See FIG. 1. Once the lead element 18 has been fully inflated to the extended position E, the valve control system 34 actuates the valve assembly 32 to begin inflating (I) the tail element 22 and to begin venting or deflating (D) the intermediate element 20. Since the length L (FIG. 1) between the leading and trailing ends 26 and 28 of the bellows assembly 16 remains substantially constant, the axial expansion of the tail element 22 that occurs upon its inflation (I) results in a corresponding axial contraction of the deflating (D) intermediate element 20. See FIG. 5(*a*). The fully extended lead element 18 prevents the bellows assembly 16 from moving with respect to the channel 14.

Once the tail element 22 is completely inflated to the extended position E, the valve control system 34 actuates the valve assembly 32 to begin inflating (I) the intermediate element 20 and to begin deflating (D) the lead element 18. See FIG. 5(*b*). Again, since the length L (FIG. 1) between the leading and trailing ends 26 and 28 of the bellows assembly 16 remains substantially constant, the axial expansion of the intermediate element 20 that occurs on its inflation results in a corresponding axial contraction of the lead element 18, thus assisting in its deflation (D).

After the intermediate element 20 is fully inflated to the extended position E, the valve control system 34 again actuates the valve assembly 32 to begin inflating (I) the lead element 18 and to begin deflating (D) the tail element 22. See FIG. 5(*c*). As the lead element 18 inflates, it expands axially in the direction indicated by arrow 46, thus advancing the tether 24 in the same direction and by the same amount. The inflation (I) of the lead element 18 also assists in the deflation (D) of the tail element 22 in the manner already described. Since the trailing end 28 of the tail element 22 is fixedly attached to the tether 24, the contraction of the tail element 22 also pulls forward the tether 24. Finally, once the lead element 18 is fully inflated to the extended position E, the valve control assembly 34 actuates the valve assembly 32 to deflate the intermediate element 20 and inflate the tail element 22 (FIG. 5(*d*)). The cycle then repeats.

As will be described in greater detail below, the tether puller 10 is modular and several bellows assemblies may be connected end to end on the tether 24 to provide increased tractive force. See FIG. 6. For example, some applications may produce relatively little tether drag, in which case a single bellows assembly 16 may well provide sufficient tractive force to overcome the expected tether drag. However, other applications having longer runs or more turns may require two or more sets of bellows assemblies, such as bellows assemblies 16 and 116, to overcome the expected tether drag.

A significant advantage associated with the present invention is that the tether puller 10 pulls the tether 24 along behind the advancing boring head 12, thereby effectively reducing or eliminating the tether drag, but without adversely affecting the ability of the boring head 12 to maneuver underground and without restricting it to making only relatively large radius turns. Another advantage is that the independently inflatable elements 18, 20, and 22 that comprise the bellows assembly 16 are compatible with a wide range of tethers and tether configurations and do not require a hermetic or air-tight seal between the inflatable elements and the tether. The tether puller 10 is also reversible. That is, a rearward tractive force can be applied to the tether by simply reversing the inflation/deflation sequence of the various elements 18, 20, and 22. Still another advantage of the present invention is that it is very tolerant of underground obstacles, such rock and other hard or abrasive debris, which may harm other types of tether puller apparatus.

Figure 6:
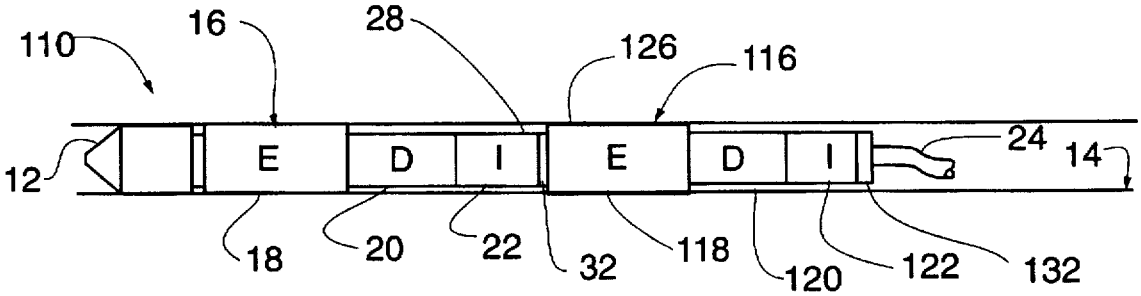
FIG. 6 is a schematic representation of another embodiment of the tether puller having two bellows assemblies connected together to provide increased tractive force.

Other advantages are associated with the modular design of the tether puller. For example, in boring applications expected to produce only a small tether drag, a single bellows assembly 16 may well provide sufficient tractive force to advance the tether 24 along with the boring head 12. However, in other applications in which much greater tether drag is expected, another bellows assembly 116 may be connected to the first bellows assembly 16 to produce greater tractive force, as best seen in FIG. 6. Indeed, any number of bellows assemblies, such as bellows assemblies 16 and 116, may be connected end to end in the manner shown in FIG. 6 to produce a tractive force sufficient to overcome even the greatest tether drag. Consequently, the present invention may be customized for use in a wide range of boring applications by simply selecting the appropriate number of bellows assemblies, such as bellows assemblies 16 and 116, required to overcome the expected tether drag.

Having briefly described the tether puller 10 according to the present invention, as well as some of its more significant features and advantages, the tether puller 10 and its associated apparatus will now be described in detail. Referring back now to FIG. 1, one embodiment of the tether pulling apparatus 10 is shown as it could be used with an impact boring head 12 of the type described in my co-pending application, Ser. No. 08/613,301, filed on Mar. 11, 1996, entitled "Maneuvering Impact Boring Head," which is hereby incorporated by reference for all it discloses. However, it should be understood that the tether puller 10 according to the present invention could be used with any of a wide variety of other types of self-propelled boring heads that are readily commercially available. Indeed, the tether puller 10 also could be used in a wide range of applications where it would be advantageous to provide a tractive force to any elongate or conduit-like member that needs to be advanced within a tube or channel. Therefore, the present invention should not be regarded as limited to any one particular type of boring head or to any one particular application.

Most self-propelled boring heads, such as boring head 12, are connected to a remote boring head control system 30 via a flexible tether 24. As was briefly described above, the tether is usually used to supply power and control signals to the boring head 12. Accordingly, the flexible tether 24 may include electrical wires, cables, hoses, or any other of a wide variety of flexible, conduit-like members that may be required to provide boring power, steering power, position sensing, feedback, or other functions to the boring head. In addition, the tether 24 may also include one or more cables, wires, or hoses that are to be installed in the channel 14.

Figure 2:
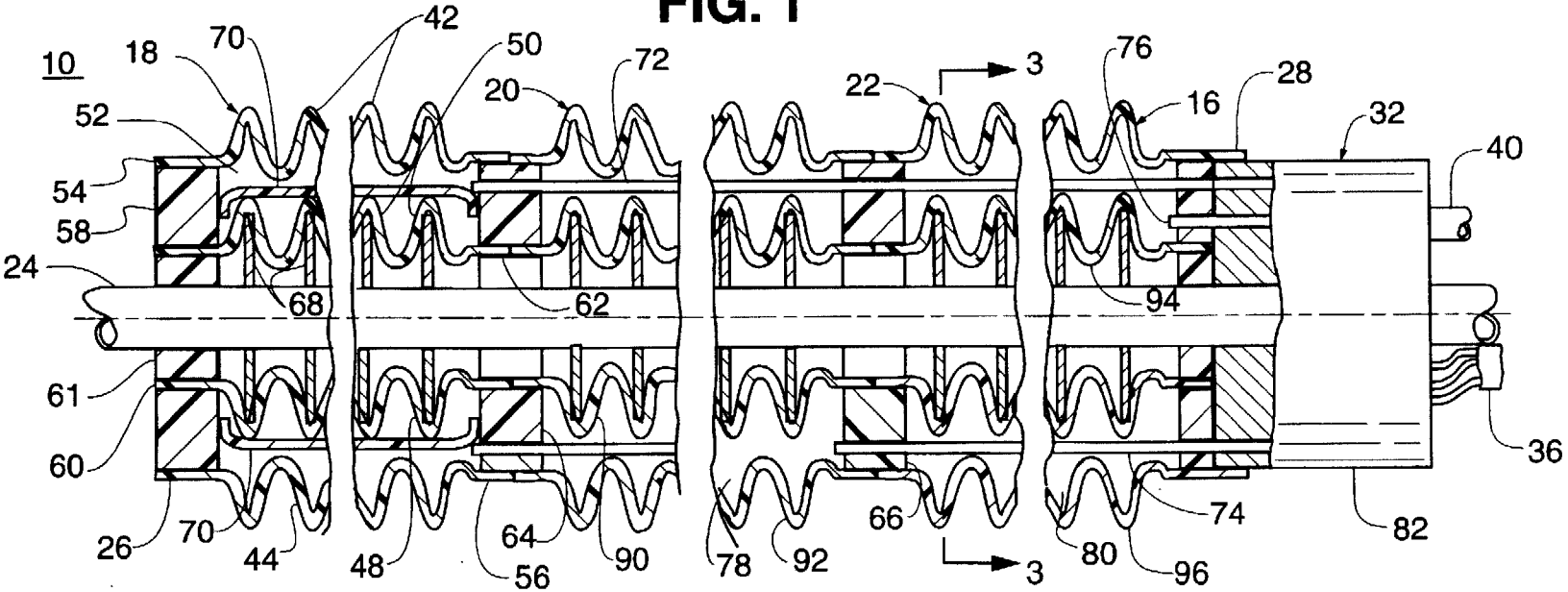
FIG. 2 is an enlarged cross-section view in elevation of the bellows assembly of the tether puller showing the structure of the independently inflatable elements.

Still referring to FIG. 1, the leading end 26 of the tether puller 10 may be mounted directly to the boring head 12. Alternatively, the leading end 26 may be secured directly to the tether 24, as will be described below. The valve assembly 32 is mounted to the trailing end 28 of the tether puller 10, as best seen in FIGS. 1 and 2. The valve assembly 32 is also fixedly mounted to the tether 24 so that the length L between the leading end 26 and the trailing end 28 will remain substantially constant during the operation of the tether puller 10.

The tether pulling apparatus 10 may comprise a bellows assembly 16 having three independently inflatable elements: A lead element 18, an intermediate element 20, and a tail element 22, each of which is substantially identical . However, before proceeding with a description of the various independently inflatable elements 18, 20, and 22 that comprise bellows assembly 16, it should be noted that a minimum of three independently inflatable elements are required to exert a forward or reverse force to the tether 24. However, persons having ordinary skill in the art will recognize that the bellows assembly 16 could comprise four, five, or even more such elements and still achieve the objects of the present invention by merely changing the sequence in which the various elements are inflated. Therefore, the bellows assembly 16 should not be regarded as limited to a configuration having only three independently inflatable elements. Since each element 18, 20, and 22 is essentially identical, only the lead element 18 will be described in detail.

Referring solely now to FIG. 2, lead element 18 may comprise a flexible and resilient outer bellows 44 and a flexible and resilient inner bellows 48 joined together at either end by ring-shaped members 58 and 64 so that an annular air-tight chamber 52 is created therebetween. More specifically, the forward end 54 of outer bellows 44 and the forward end 60 of inner bellows 48 are bonded to the ring shaped member 58 so as to form a substantially air-tight seal. Ring shaped member 58 is in turn fixedly attached to the tether 24 by any convenient means, such as by a sleeve 61. Similarly, the aft ends 56 and 62 of the respective outer and inner bellows 44 and 48 are bonded to ring-shaped member 64 so that a substantially air-tight seal is formed therebetween. However, ring-shaped member 64 is not bonded or attached to the tether 24.

Figure 3:
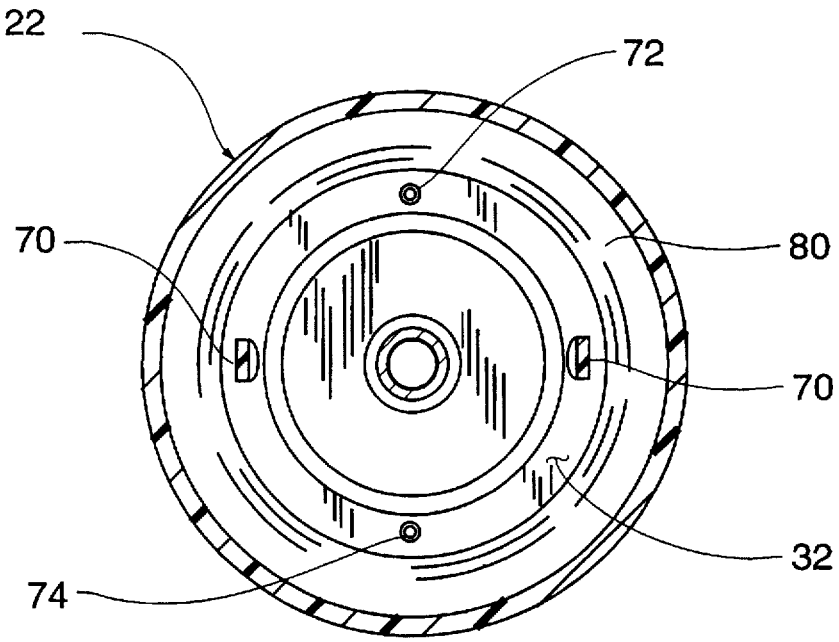
FIG. 3 is a cross section view in elevation taken along the line 3—3 of FIG. 2 more clearly showing the arrangement of the spacers for preventing the inner bellows from contacting the tether.

A plurality of ring-shaped spacers 68 are positioned in the various corrugations 50 of the inner bellows 48 in the manner shown in FIGS. 2 and 3 to prevent the inner bellows 48 from contacting the tether 24 when element 18 is inflated. Lead element 18 may optionally include axial biasing members, such as resilient bands 70, connected between ring shaped members 58 and 64 to assist in deflating the element 18. Finally, the annular chamber 52 defined between the inner and outer bellows 48, 44 is connected to the valve assembly 32 by a flexible hose 72 passing through ring shaped member 64.

A plurality of corrugations 42 and 50 on the respective outer and inner bellows 44 and 48 allow the outer bellows 44 to expand both in a radial direction and in an axial direction upon inflation. As was briefly described above, the corrugations 42 on the outer bellows 44 also frictionally engage the channel 14 upon inflation, as best seen in FIG. 1. The inner bellows 48 expands in a similar manner, except that it tends to expand radially toward the tether 24 upon inflation. However, the ring-shaped spacers 68 prevent the inner bellows 48 from contacting the tether 24 and possibly interfering with the relative movement between the tether 24 and the tether puller 10 as the various inflatable elements 18, 20, and 22 expand and contract.

The structure of the intermediate and tail inflatable elements 20 and 22, respectively, is essentially identical to the structure of the lead inflatable element 18. That is, the inner and outer bellows 90 and 92 of the intermediate element 20 are attached to the ring-shaped members 64 and 66 in the manner described above and form air-tight annular chamber 78. Another ring-shaped member 66 connects the inner and outer bellows 94 and 96 of tail element 22 to the intermediate element 20 in an identical manner. As was the case for ring-shaped member 64, ring-shaped member 66 is not mounted to the tether 24 and is free to slide axially along the length of the tether 24.

The trailing end 28 of the tail element 22 may be mounted to the valve assembly 32. However, depending on the construction of the valve assembly 32, it may be desirable to bond the inner and outer bellows 94 and 96 of tail element 22 to sealing member 98 to ensure a substantially air-tight seal between annular chamber 80 and valve assembly 32. As was the case for the lead ring shaped member 58, the valve assembly 32 is fixedly mounted to the tether 24. Since both the leading and trailing ends 26 and 28 of the bellows assembly 16 are fixedly attached to the tether 24, the overall length L (FIG. 1) between the leading end 26 and tailing end 28 will remain substantially constant during operation of the tether puller 10. Finally, the annular chambers 78 and 80 may be fluidically connected to the valve assembly 32 by respective flexible hoses 74 and 76 routed through the various annular chambers 78 and 80 in the manner shown in FIGS. 2 and 3.

While the various inner bellows 48, 90, and 94 and outer bellows 44, 92, and 96 comprising bellows assembly 16 may be made from any of a wide variety of flexible and resilient materials having properties sufficient to allow them to withstand the expected service conditions, the inner bellows 48, 90, and 94 and outer bellows 44, 92, and 96 in one preferred embodiment are made from a 50 durometer urethane material. Similarly, the ring shaped members 58, 64, and 66 may be made from 70 durometer urethane material, although other materials could be used without departing from the scope of the present invention.

Figure 4:
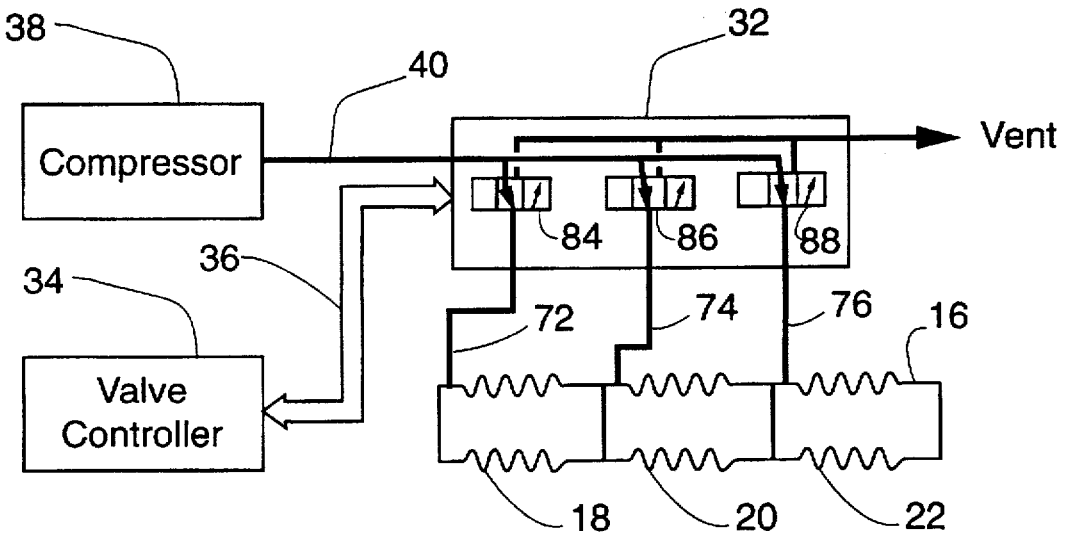
FIG. 4 is a schematic of the inflation control system used to cyclically activate selected ones of the independently inflatable elements.
Figure 5A:
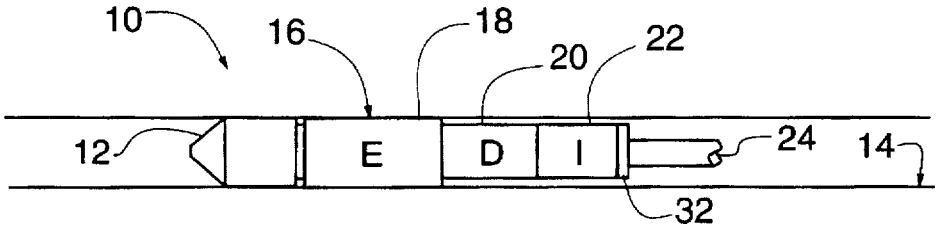
FIGS. 5(*a*–*d*) are schematic representations of one type of inflation sequence that may be used to advance the tether pulling apparatus in the channel.
Figure 5B:
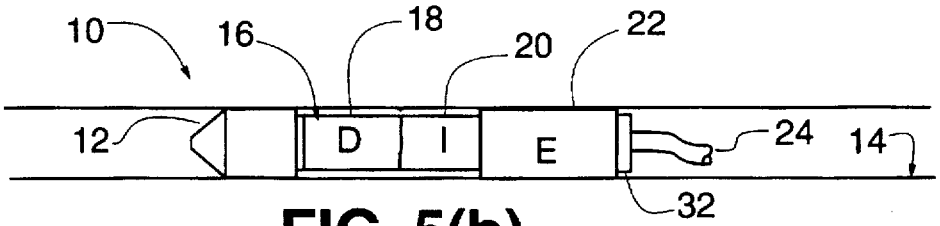
Figure 5C:
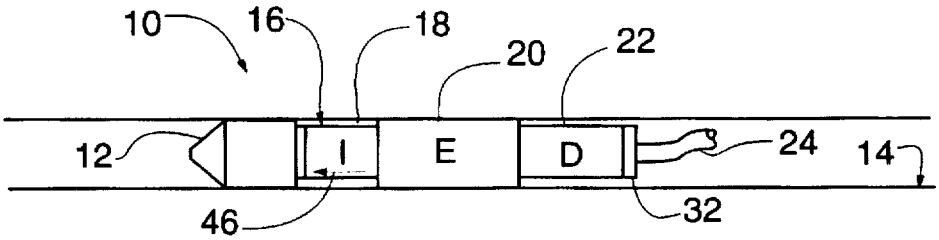
Figure 5D:
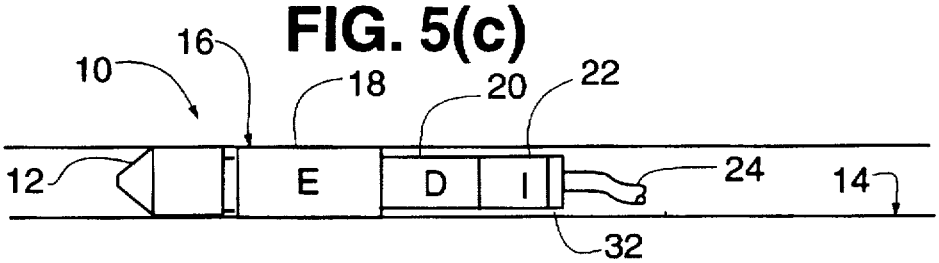

The details of the valve assembly 32 are best understood by referring to FIG. 4 with occasional reference back to FIG. 2. Essentially, valve assembly 32 comprises a housing 82 within which are mounted a plurality of valves 84, 86, and 88 (not shown in FIG. 2, but shown schematically in FIG. 4) for controlling the inflation and deflation of the respective elements 18, 20, and 22 of bellows assembly 16. Each valve 84, 86, and 88 is identical and can be actuated by the valve control system 34 to connect the annular chambers 52, 78, and 80 of the respective elements 18, 20, and 22 to a supply of compressed air provided by the compressor system 38. Alternatively, the valves 84, 86, and 88 may be actuated to connect the respective annular chambers 52, 78, and 80 to a vent. Each element 18, 20, and 22 will inflate when its respective valve 84, 86, and 88 connects it to the compressor system 38 and will deflate when connected to the vent.

In one preferred embodiment, each valve 84, 86, and 88 comprises a 3-way valve (model no. H041E1) available from Humphrey Products Co. of Kalamazoo, Mich., although other kinds of valves could also be used, as would be obvious to a person having ordinary skill in the art after having become familiar with the details of the present invention. The compressor system 38 is designed to supply compressed air (not shown) to the valve assembly 32 via a hose 40 at a regulated pressure of about 30 pounds per square inch gauge (psig), although other pressures could also be used.

The valve control system 34 may comprise a general purpose programmable computer, such as a personal computer (PC) programmed to cycle the various valves 84, 86, and 88 as required to move the tether puller apparatus in either a forward direction, as shown in FIGS. 5(*a*)–(*d*), or in a reverse direction (not shown). Alternatively, a programmable logic controller of the type that are readily commercially available could also be used. In any case, since the such personal computers and programmable logic controllers are well known in the art and could be easily provided by persons having ordinary skill in the art after becoming familiar with the teaching of the present invention, the valve control system 34 will not be described in further detail.

In accordance with the foregoing description, then, the bellows assembly 16 includes three inflatable elements 18, 20, and 22, each of which may be independently inflated and deflated via actuation of the respective valves 84, 86, and 88. As a given element is inflated, the outer bellows of that element expands radially to contact the wall of the channel 14 (FIGS. 1 and 5), thereby holding the position of the tether puller 10 within the channel 14. The axial expansion and contraction of the various elements allows the tether puller 10 to exert a tractive force on the tether 24, advancing it along with the boring head 12. Finally, and as noted above, the axial extension of an inflating element will necessarily require the same amount of axial contraction of a deflating element since the bellows assembly 16 is secured to the tether 24 at its leading and trailing ends 26 and 28.

The tether puller apparatus 10 according to the present invention may be operated to pull the attached tether 24 in the direction of advance of the boring head 12 by selectively inflating and deflating selected ones of the lead, intermediate, and tail elements 18, 20, and 22 in a repeating cycle. For example, referring now to FIGS. 5(*a*)–(*d*), an initial state of the tether puller 10 may comprise the state wherein the lead element 18 is fully inflated and in the extended position E and wherein the intermediate element 20 is deflating (D) and the tail element 22 is inflating (I). As the tail element 22 is inflated (I), it expands in both the radial and axial directions which causes the deflating (D) intermediate element 20 to contract axially by the same amount. The intermediate element 20 continues to deflate and contract axially until the tail element 22 is fully inflated to the extended position E.

Once the tail element 22 is fully inflated and in the extended position E, the valve control system 34 (FIG. 4) actuates the valves 84, 86, and 88 as necessary to begin inflating (I) the intermediate element 20 and deflating (D) the lead element 18. See FIG. 5(*b*). The inflating (I) element 20 expands radially and axially, causing the lead element 18, which is deflating (D), to contract axially by the same amount in the manner described above. The process continues until the intermediate element 20 is fully inflated and in the extended position E.

After the intermediate element 20 has been inflated to the extended position E, the valve control system 34 again actuates the various valves 84, 86, and 88 mounted in the valve assembly 32 to begin deflating (D) the tail element 22 and inflating (I) the lead element 18. See FIG. 5(*c*). As the lead element 18 inflates, it expands radially and axially in the direction indicated by arrow 46. Since the lead element 18 is attached to the tether 24, the axial extension of the lead element 18 in the direction of arrow 46 moves the tether 24 in the same direction and by substantially the same distance. At the same time, the expanding lead element 18 assists in contracting the tail element 22 by pulling on the tether 24. The process continues until the lead element 18 is fully inflated to the extended position E, at which time the valve control system actuates the valve assembly 32 to begin deflating (D) the intermediate element 20 and inflating (I) the tail element 22. See FIG. 5(*d*). The foregoing process is then repeated, each time advancing the tether 24 upon inflation of the lead element 18.

While the time for performing the various cycles comprising the advance sequence described above will necessarily vary depending on the exact design of a particular tether puller 10 embodying the present invention and, of course, on the advance rate of the boring head 12, one preferred embodiment of the tether puller 10 utilizes a time of about 1.5 seconds per step, in which case a single advance cycle (i.e., FIGS. 5(*a*)–(*d*)) is completed in about 4–6 seconds.

The foregoing description is directed to a tether pulling apparatus 10 having a single bellows assembly 16 for advancing the tether 20. However, as was mentioned above, the tether puller apparatus 10 may be modified to comprise two, three, or even more sets of bellows assemblies for increased pulling power. For example, another embodiment 110 of the tether pulling apparatus is shown in FIG. 6 that comprises a second bellows assembly 116 attached to the first bellows assembly 16. The second bellows assembly 116 utilized in the second embodiment 110 is essentially identical to the bellows assembly 16, and comprises a lead element 118, an intermediate element 120, a tail element 122, and a valve assembly 132. Of course, the second bellows assembly 116 would also comprise the necessary electrical and pneumatic connectors (not shown) to allow the valve actuation signals from the valve controller 34 (FIG. 1) and, of course, the compressed air from compressor system 38, to reach the first bellows assembly 16.

Each bellows assembly, such as bellows assemblies 16 and 116, of such a combination arrangement is synchronized so that the various elements 18, 20, 118, 120, etc. are inflated and deflated together. For example, in the initial state of the advance cycle shown in FIG. 6, both lead elements 18, 118 are fully inflated to the extended position E, while both intermediate elements 20 and 120 are being deflated (D) and while both tail elements 22 and 122 are being inflated (I). Any number of bellows assemblies may be so connected together in the manner described above to provide sufficient tractive force to the tether 24 for nearly any application and circumstance.

This completes the detailed description of the various embodiments of the tether puller 10 according to the present invention. While a number of specific components were described above for the preferred embodiments of this invention, persons having ordinary skill in the art will readily recognize that other substitute components or combinations of components may be available now or in the future to accomplish comparable functions to the various components shown and described herein. For example, while the tether puller 10 is shown and described herein as it could be used to advance a tether 24 trailing behind a self-advancing boring head 12, the tether puller 10 could be used in any other application wherein it would be desirable to apply a tractive force to an elongate or conduit like member. Still other modifications are possible. For example, the bellows assembly 16 shown and described herein comprises three independently inflatable elements 18, 20, and 22. However, the bellows assembly 16 could be modified to include four or more independently inflatable elements without departing from the spirit and scope of the present invention.

In sum, then, it is contemplated that the inventive concepts herein described may be variously otherwise embodied and it is intended that the appended claims be construed to include alternative embodiments of the invention except insofar as limited by the prior art.

What is claimed is:

1. A tether puller for advancing a tether through a channel, comprising:

a bellows assembly having a leading end fixedly attached to the tether at a first position and a trailing end fixedly attached to the tether at a second position so that the leading and trailing ends of said bellows assembly are located a substantially fixed distance apart, said bellows assembly having an elongate axial passage adapted to receive the tether so that the tether is substantially concentric with said bellows assembly, said bellows assembly also including a plurality of independently inflatable elements 'each of which may be separately inflated to an extended position and deflated to a retracted position, each of said plurality of independently inflatable elements expanding radially and axially upon inflation each of said independently inflatable elements comprising and annular chamber having an inner bellows surrounding the tether and an outer bellows surrounding the inner bellows, said annular chamber being defined between the inner bellows and the outer bellows; and inflation means connected to each of said plurality of independently inflatable elements for inflating and deflating selected ones of said plurality of independently inflatable elements to cause said bellows assembly to advance in the channel.

2. The tether puller of claim 1, wherein said bellows assembly comprises three independently inflatable elements.

3. The tether puller of claim 1, wherein said inflation means comprises:

a supply of a pressurized fluid;

a valve assembly fluidically connected to said supply of a pressurized fluid and to said bellows assembly for selectively connecting and disconnecting each of said plurality of independently inflatable elements to the pressurized fluid; and control means operatively associated with said valve assembly for actuating said valve assembly to inflate and deflate selected ones of said plurality of independently inflatable elements.

4. A tether puller for advancing a tether through a channel, comprising:

a first inflatable element having an inner bellows and an outer bellows, the inner bellows surrounding the tether and the outer bellows surrounding the inner bellows so that a first annular inflation chamber is defined between the inner bellows and the outer bellows, the inner and outer bellows being joined together at a leading end and a trailing end, the leading end of said first inflatable element being fixedly attached to the tether;

a second inflatable element having an inner bellows and an outer bellows, the inner bellows surrounding the tether and the outer bellows surrounding the inner bellows so that a second annular inflation chamber is defined between the inner bellows and the outer bellows, the inner and outer bellows being joined together at a leading end and a trailing end, the leading end of said second inflatable element being attached to the trailing end of said first inflatable element;

a third inflatable element having an inner bellows and an outer bellows, the inner bellows surrounding the tether and the outer bellows surrounding the inner bellows so that a third annular inflation chamber is defined between the inner bellows and the outer bellows, the inner and outer bellows being joined together at a leading end and a trailing end, the leading end of said third inflatable element being attached to the trailing end of said second inflatable element and the trailing end of said third inflatable element being fixedly attached to the tether; and inflation means connected to said first, second, and third inflatable elements for selectively inflating and deflating the first, second, and third annular inflation chambers of respective ones of said first, second, and third inflatable elements, wherein said first, second, and third inflatable elements expand radially and axially upon inflation.

5. The tether puller of claim 4, wherein said inflation means comprises:

a supply of a pressurized fluid;

a valve assembly fluidically connected to said supply of a pressurized fluid and to said bellows assembly for selectively connecting and disconnecting each of said first, second, and third inflatable elements to the pressurized fluid; and control means operatively associated with said valve assembly for actuating said valve assembly to inflate and deflate selected ones of said first, second, and third inflatable elements.

6. A method for advancing a tether through a channel, comprising the steps of:

inflating a lead element attached to the tether to an expanded state so that the lead element frictionally engages the channel to prevent substantial axial movement of the tether within the channel;

while the lead element is in the expanded state, inflating a tail element to an expanded state and deflating an intermediate element positioned between the lead and tail elements;

while the tail element is in the expanded state, deflating the lead element and inflating the intermediate element to an expanded state; and while the intermediate element is in the expanded state, deflating the tail element and inflating the lead element to an expanded state.

* * * * *